United States Patent [19]

Petzi

[11] 4,123,044

[45] Oct. 31, 1978

[54] TUNNEL FURNACE

[75] Inventor: Fritz Petzi, Nuremburg, Fed. Rep. of Germany

[73] Assignee: Ludwig Riedhammer GmbH & Co. K.G., Nuremburg, Fed. Rep. of Germany

[21] Appl. No.: 814,400

[22] Filed: Jul. 11, 1977

[30] Foreign Application Priority Data

May 7, 1977 [DE] Fed. Rep. of Germany ..... 2720630

[51] Int. Cl.[2] ..... F27B 9/14

[52] U.S. Cl. ..... 266/255; 193/17; 198/631

[58] Field of Search ..... 75/21, 33–35; 193/17, 18; 198/631; 241/18R; 432/134; 266/177, 252, 254, 255, 257

[56] References Cited

U.S. PATENT DOCUMENTS

| | | | |
|---|---|---|---|
| 2,404,650 | 7/1946 | Newkirk et al. | 432/134 |
| 2,521,591 | 9/1950 | Martin | 432/134 |
| 2,886,303 | 5/1959 | Rusciano | 266/257 |
| 3,029,141 | 4/1962 | Sibakin et al. | 75/34 |
| 3,942,659 | 3/1976 | Burmeister | 214/18 R |
| 4,039,794 | 8/1977 | Kasper | 266/252 |

FOREIGN PATENT DOCUMENTS

| | | | |
|---|---|---|---|
| 494,965 | 9/1919 | France | 432/134 |

*Primary Examiner*—Gerald A. Dost

*Attorney, Agent, or Firm*—Ross, Ross & Flavin

[57] ABSTRACT

A tunnel furnace comprises an elongate hollow structure inclined to have one end higher than the other and is reciprocable about an axis parallel to its length, heaters for heating material to be treated being incorporated in the structure.

1 Claim, 2 Drawing Figures

TUNNEL FURNACE

FIELD OF THE INVENTION

Chiefly in the field of powder metallurgy there is material which in a very short time, for example in 10 minutes to 1 hour, has to be subjected to a temperature treatment inside a furnace.

DESCRIPTION OF THE PRIOR ART

Fundamentally the revolving tubular furnace offers itself for such treatment. More especially because the material to be treated is entrained in revolving manner, relatively short furnace times can be made possible. In the case of the revolving tubular furnace, however, the end faces are largely open. Consequently, a considerable pollution of the surroundings of the furnace occurs. What is furthermore disadvantageous is the fact that a desired gas atmosphere cannot be produced or even maintained inside the revolving tubular furnace. What is moreover disadvantageous is the fact that the heating of the revolving tubular furnace can be effected only from one end face. Consequently the overall length of the revolving tubular furnaces is limited, because the burner flame can be effective only over a specific length. A desired temperature along the revolving tubular furnace can likewise not occur. Difficulties are also afforded by the temperature measurement, because it is impossible to allow measuring instruments to project into the interior of the furnace at specific locations along the revolving tubular furnace from the side wall.

OBJECT OF THE INVENTION

An object of the present invention is to provide an elongate sintering furnace, more especially for powder metallurgy, with delivery of the material to be treated at the one end and removal of the material to be treated at the other end, of such construction that along the sintering furnace a temperature can be set and maintained in accordance with an arbitrarily-extending curve and that the sintering furnace can be of any desired dimension in length. Moreover, it is to be possible to produce and maintain a desired gas atmosphere in the interior of the sintering furnace.

BRIEF STATEMENT OF THE INVENTION

The invention provides a sintering furnace, longitudinally inclined, more especially for powder metallurgy, mounted for swinging movement in the transverse direction on a support and having a drive which sets it into a swinging to-and-fro motion, and is equipped along its longitudinal extent laterally with burners.

The pendulum movement of the sintering furnace in the transverse direction ensures a good intermixture of the material to be treated and a uniform thorough sintering (or percolation) of the same. Because the burners are arranged along the longitudinal extent of the sintering furnace, they can be situated everywhere where the supply of heat is desired. The furnace in accordance with the invention can thus be run in accordance with a desired temperature curve. Also it can be of any desired dimension in length. A particularly short mode of construction can of course be achieved if the sintering furnace is, in accordance with a further feature of the invention, designed along the lines of a trough with a lower muffle and an upper cover. The width of the muffle can, in the case of the mode of construction of the sintering furnace in accordance with the invention, be relatively large.

It is additionally particularly advantageous if the cover is removable. With such a design, by lift-off of the cover the interior of the sintering furnace becomes accessible at any time. Should the material to be treated be for instance bake on, the baked-on material can be loosened by means of push rods relatively simple at any furnace location.

DESCRIPTION OF A PREFERRED EMBODIMENT

Figure 2:
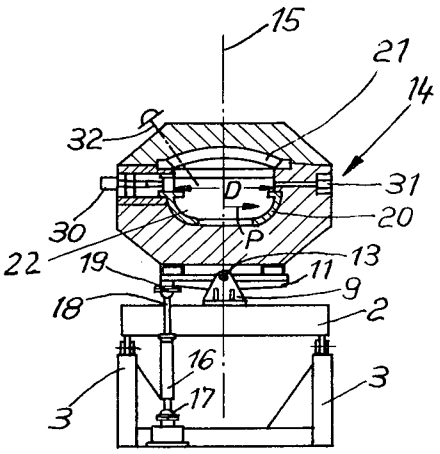
FIG. 2 is a view in cross section through the FIG. 1 sintering furnace.
Figure 1:
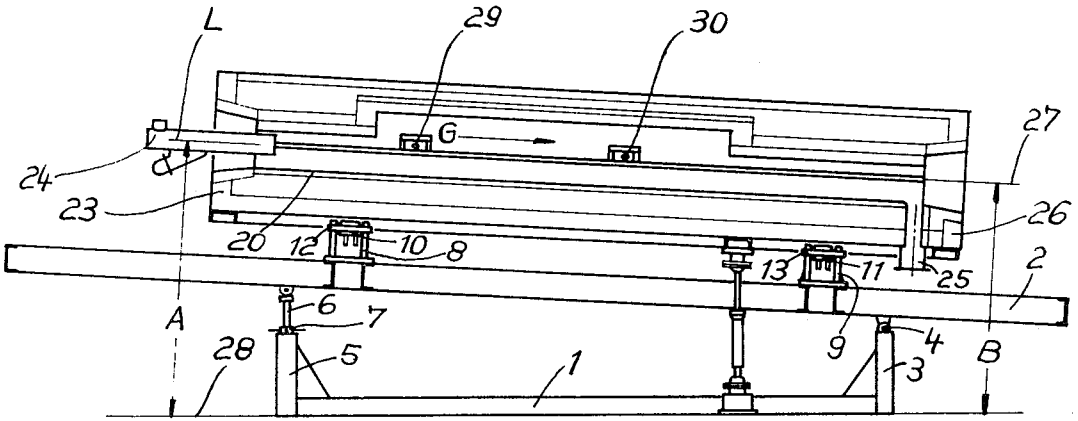
FIG. 1 is a view, in side elevation, of the sintering furnace of the invention.

Mounted in inclined manner on a chassis 1 is a box frame 2. Frame 2 is on the one hand hinged at 4 to be supports 3, and on the other hand is designed so as to be adjustable in height in the supports 5 by means of a threaded spindle 6 and screwed nuts 7 which are actuatable by hand. Fastened on the box frame 2 are brackets 8, 9. In these struts 10, 11 are mounted for swinging movement by means of the pivots 12, 13 along the lines of a balance beam. Fastened to the struts 10, 11 is the actual furnace 14. In this respect, care is taken to see that the perpendicular centre bisectrix 15 runs through the centre of the pins pivots 12, 13.

Hinged at 17 to the lower end of the chassis 1 is a hydraulic cylinder 16. A piston rod 18 is hinged at 19 to the one free end of the strut 11. By means of the hydraulic cylinder 16, 18, the furnace 14 can be swung angularly in the direction of and the opposite direction to the arrow P about the pivots 12, 13. Thus the furnace can be displaced, transversely to its longitudinal extent, into a reciprocating oscillating motion. This pendulum movement can be effected continuously, but it could also, if necessary, be carried out periodically.

The furnace 14 is designed along the lines of an elongate trough. This trough comprises a lower muffle 20 and an upper cover 21. The cover 21 can be connected securely to the muffle 20. The design can, however, also be made such that the cover 21 can be lifted off from the muffle 20. In this case, the interior 22 of the furnace is accessible at any time.

The furnace 14 is sealed at its upper end face 23 save for the feed pipe 24 for the material to be treated. The outlet pipe 25 is situated at the lowest point of the muffle 20. The furnace is also tightly sealed at the lower end face 26.

The furnace 14 is installed in inclined manner, in such a way that the feed pipe 24 lies higher than the centre 27 at the lower end face 26. Thus the distance A of the longitudinal central line L from the base 28 is greater than the distance B from this base. The respectively desired inclination can be set by means of the threaded spindle 6 and the screw nuts 7.

The burners 29, 30 are arranged laterally along the longitudinal extent of the furnace 14. For the injection of possible gases, additionally suitable feed pipes 31 can be provided on the opposite side of the burners. The temperature measuring apparatuses are mounted in the cover, so that they are extensively protected from the material to be treated upon the pendulum movement of the furnace. One such temperature measuring apparatus is indicated on the drawing by the reference symbol 32.

The burners 29, 30 sweep with their flames relatively great lengths, for example distances of 7m and above. Consequently, the trough can be made relatively wide in dimension in its transverse extent D, without it having to be feared that the material to be treated present in the muffle 20 will be heated differently in the transverse extent. The lateral arrangement of the burners make it possible, in addition to this, to arrange the heating zone in such a way that a desired temperature curve can be readily set and maintained along the extend of the furnace. The feed pipes 31 and the fact of the frontal tight closure make it possible, furthermore, to produce and maintain a desired composition of the gas atmosphere within the furnace interior 22.

For sintering, the material to be treated, chiefly in granulate form, for example precious metal granulate, is introduced into the feed pipe 24. The burners 29, 30 are put into operation and the furnace 14 is set into a continuous reciprocating pendulum movement by means of the hydraulic drive 16, 18. The granulate fed to the interior 22 passes onto the muffle 20 and is moved, along with the action of the heat and the atmosphere present in the interior 22, from right to left and from left to right and travels as a result of the inclination of the furnace and gravity in the direction of the arrow G along the furnace in order finally to be carried off via the discharge pipe 25. The result can readily be achieved that the material for treatment is subjected, in the high temperature region of the sintering furnace, to temperatures of more than 1400° C.

Because the material to be treated comes into contact only with the lower part of the trough, in other words the muffle 20, it is sufficient to design this muffle from high-grade material, in order to keep down the wear thereof, whereas the cover 21 needs to consist of far less high-grade material. This is because the material to be treated does not come into contact with the cover.

Should the material to be treated bake onto the muffle upon operation of the furnace, the hindrance thereby afforded can easily be obviated by the cover 21 being designed so that it can be lifted off. With such a construction, the interior 22 is, after removal of the cover 21, freely accessible, so that the baked-on material can readily be removed by means of push rods.

Because the furnace is securely closed frontally, any pollution of the environment is precluded.

Through the pendulum movement of the furnace, a uniform sintering-through of the material to be treated is achieved.

The stroke (or lift) of the hydraulic cylinder 16, 18 is chosen as a function of the angle of repose of the material to be treated.

Although the furnace shown offers many advantages, the trough form can, however, be dispensed with and for instance the cylinder tube form be chosen. Fundamentally, the essential advantages which the described oscillating tank furnace offers are, in this respect, retained.

I claim:

1. In a sintering kiln for metal ceramics being inclined along its longitudinal axis and mounted for swinging movement in the transverse direction and incorporating: a lower muffle (20), an upper removable trough ceiling (21) connected to the lower muffle, a chassis (1), a box frame (2) mounted in inclined position on the chassis (1), transverse struts (10, 11) pivotally mounted in the manner of a balance beam on the box frame (2), a hydraulic cylinder (16) and piston rod (18) associated therewith, the piston rod (18) being hingedly connected to a free end of the transverse strut (11), the hydraulic cylinder (16) being hingedly connected to the support chassis, burners (29, 30) and gas infeed pipes (31) being mounted laterally along the longitudinal extent of the kiln.

* * * * *